US005139139A

United States Patent [19]

Goetz

[11] Patent Number: 5,139,139

[45] Date of Patent: Aug. 18, 1992

[54] PAINT TRAY

[75] Inventor: Charles R. Goetz, Carnegie, Pa.

[73] Assignee: Alco Industries, Inc., Valley Forge, Pa.

[21] Appl. No.: 722,596

[22] Filed: Jun. 27, 1991

Related U.S. Application Data

[63] Continuation-in-part of Ser. No. 484,113, Feb. 23, 1990, abandoned.

[51] Int. Cl.[5] ..... B05C 11/10; B05C 21/00

[52] U.S. Cl. ..... 206/229; 15/257.06; 206/462

[58] Field of Search ..... 15/257.05, 257.06; 206/361, 362, 372, 229, 462

[56] References Cited

U.S. PATENT DOCUMENTS

| | | | |
|---|---|---|---|
| D. 273,725 | 5/1984 | Goetz . | |
| D. 301,785 | 6/1989 | Goetz . | |
| 3,087,190 | 4/1963 | Werner | 15/520 |
| 3,110,921 | 11/1963 | Conner | 15/257.06 |
| 3,135,000 | 6/1964 | Rasmussen | 15/4 |
| 3,545,605 | 12/1970 | Robins | 206/47 |
| 4,106,434 | 8/1978 | Vines | 118/258 |
| 4,107,815 | 8/1978 | Dumesnil, Jr. | 15/257.05 |
| 4,164,803 | 8/1979 | Zurawin et al. | 15/257.05 |
| 4,205,411 | 6/1980 | Cupp et al. | 15/257.06 |
| 4,509,226 | 4/1985 | Allison et al. | 15/257.06 |
| 4,651,379 | 3/1987 | Kern | 15/257.06 |
| 4,815,604 | 3/1989 | O'Neil et al. | 206/518 |
| 4,834,237 | 5/1989 | Henke et al. | 206/373 |

*Primary Examiner*—Edward L. Roberts

*Attorney, Agent, or Firm*—Webb, Burden, Ziesenheim & Webb

[57] ABSTRACT

A paint tray for application of paint to tools used in fine detailing, such as pads, rollers, brushes and the like. The paint tray includes two troughs, one disposed on either side of an inclined ramp in an end of the tray and intermediate the side walls of the tray. Each trough is in fluid communication with a well in the opposite end of the tray. The volume of the troughs provide stability to the paint tray when loaded with paint and facilitate application of paint to tools which require small amounts of paint. An applicator is rotatably mounted within the tray to extend into the well for application of paint to painting pads. The applicator may be cylindrical or beveled. The tray may be combined with various tools which are disposed within the well and troughs and upon the ramp to form a kit for use in trimming.

15 Claims, 8 Drawing Sheets

PAINT TRAY

BACKGROUND OF THE INVENTION

1. Field of the Invention

This invention relates to paint trays and, more particularly, to trays used in transferring paint to tools designed for paint detailing applications, such as pads, brushes and the like.

2. Description of the Prior Art

It is known to provide conventional paint trays with means for supporting a detachable roller used to apply paint to padded painting tools.

U.S. Pat. No. 4,509,226 to Allison et al. discloses a paint tray having an inclined, corrugated ramp in one end of the tray with a well in an opposite end of the tray with narrow channels on either side of the ramp. The bottom of the tray has a flat portion and two extended L-shaped portions for supporting the tray on a horizontal surface. A second embodiment of the tray is similar in design but of smaller proportion.

U.S. Pat. No. 4,164,803 to Zurawin et al. discloses a paint pan for applying paint to pads and rollers wherein a conventional paint tray is provided with integral means for supporting a removable roller which has longitudinally extending ribs and which extends between the side walls of the paint tray in the area of the well. A first embodiment has a beveled applicator mounted axially within the well between an end wall and a partition, while a second embodiment has a cylindrical applicator mounted transversely in the well.

U.S. Pat. No. 4,205,411 to Cupp et al. discloses a paint tray having a well in one end; a ramp in an opposite end; the ramp has a wiping lip; and a pair of left and right passages extend downwardly from the wiping lip adjacent the left and right side walls. A roller is journaled in the well of the tray with a stub shaft extending axially beyond each roller end face. Each stub shaft engages a trunnion bearing on a side wall adjacent the well and each trunnion bearing has an upwardly directed C-shaped recess with a narrow entrance portion at the top of each recess. Each stub shaft, therefore, snaps into a trunnion bearing and is fixed to the tray.

Finally, U.S. Pat. No. 4,834,237 to Henke et al. discloses a wall covering kit having tools, a tray and a cover which includes several storage compartments which correspond to the design of the individual tools. The compartments include holding means to secure the tools within the compartments. The cover may be reversed and placed tool side first onto the tray.

None of these references alone or in combination teaches or suggests providing a compact tray used in paint detailing with an applicator in the well. Furthermore, the prior art does not suggest a paint tray which has an applicator and, at the same time, a plurality of tools disposed within the tray to form a kit for paint detailing.

It is therefore an object of the present invention to provide an improved paint tray for paint detailing having good stability and including means for supporting an applicator in the well of the paint tray. It is a further object to provide a paint tray for paint detailing which has an applicator and which is adapted to receive a plurality of tools, such as a roller and an edger, which may be packaged within the tray to form a paint detail kit.

SUMMARY OF THE INVENTION

The present invention comprises a paint tray having two side walls, a rear wall, a front wall and a bottom wall. An inclined ramp extends from the front wall toward the rear wall intermediate of the side walls. A skirt depends from each edge of the ramp to the bottom wall at a location spaced from the adjacent side wall. The skirt, bottom wall and side wall thus form a trough on each side of the tray along the extent of the ramp. The troughs may be, and in a preferred embodiment are, in fluid communication with a paint well which is formed in the end of the tray opposite the ramp by the side walls, the rear wall, and the bottom wall. The structure provides more stability to the tray than in prior trays, so that when the tray is filled with paint and carried from one location to the other, the tray does not tend to collapse or twist, nor does it sag when placed on a flat surface. The commercialized preferred embodiment is compact and may be held and carried with one hand by gripping the underside of a trough, even when filled with paint.

The paint tray also includes integral bearings located on the side walls adjacent to the well for rotatably supporting an applicator to be used in transferring paint to tools designed for detailed painting or trimming, such as an edger. The tools may be disposed within the tray, along with the applicator, to form a kit for paint detailing.

Other features and advantages of the present invention will become apparent from the following more detailed description, taken in conjunction with the accompanying drawings, which illustrate, by way of example, the principles of the invention.

DESCRIPTION OF THE PREFERRED EMBODIMENTS

Figure 1:
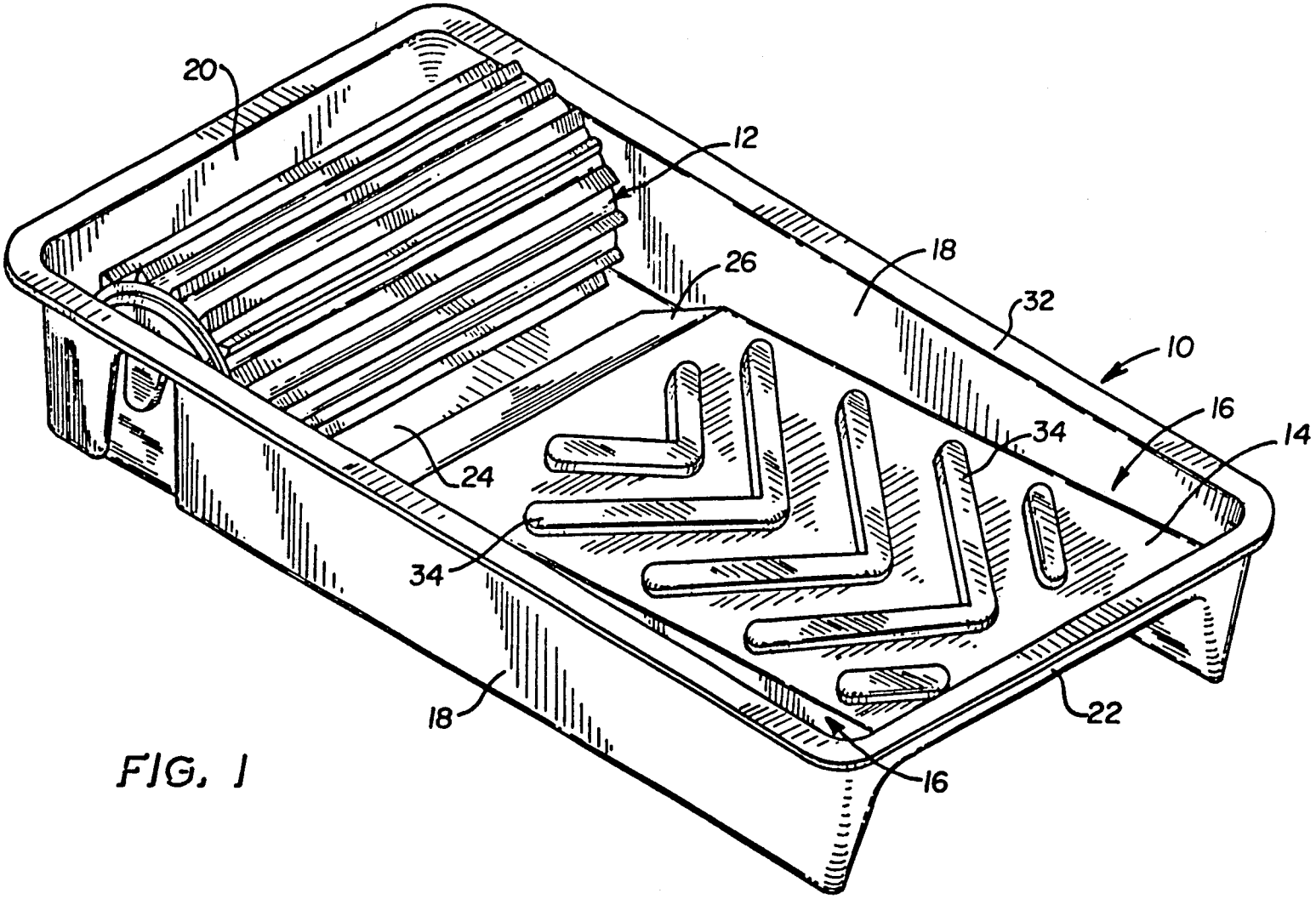
FIG. 1 is a perspective view of a paint tray with a cylindrical applicator.

As shown in FIG. 1, a paint tray 10 includes a cylindrical applicator 12 that is used to transfer paint to painting tools, such as a paint pad or the like. The tray has a ramp 14 for application of paint to rollers and for removal of excess paint from paint pads. The tray also has two troughs 16 which provide stability to the tray by evenly distributing paint weight and permit application of paint to small tools used in detailing. The paint tray 10 and cylindrical applicator 12 may be manufactured from lightweight plastic material and may be incorporated with various tools to form a kit for applying paint trim to areas requiring fine detail.

Figure 2:
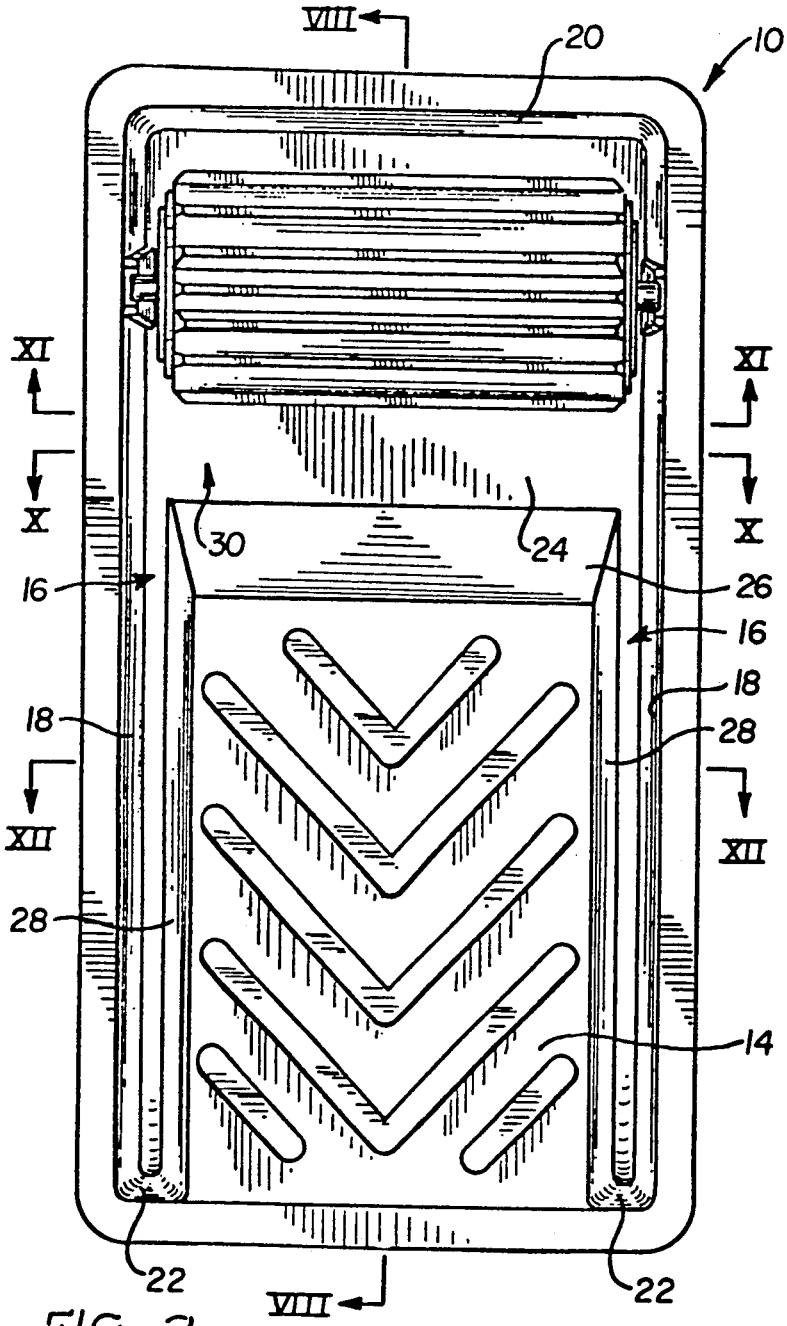
FIG. 2 is a top plan view thereof.
Figure 3:
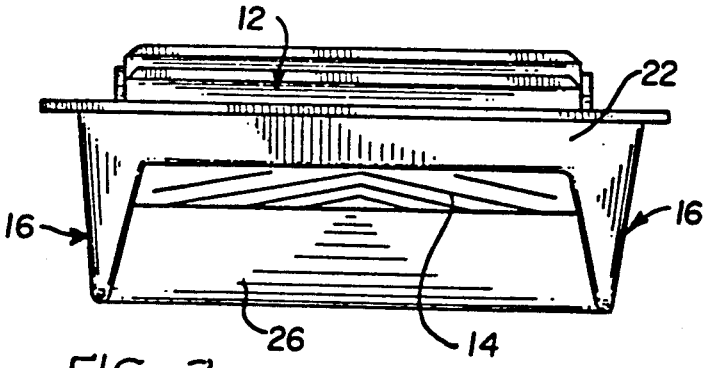
FIG. 3 is a front elevational view thereof.

The tray 10 includes two side walls 18, a rear wall 20, a front wall 22 and a bottom wall 24 which define the interior volume of the tray. The ramp 14 extends from the front wall 22 and gradually declines toward the rear wall 20. A first skirt 26 depends from the front edge of the ramp and continues on a steeper gradient to join the bottom wall 24. Lateral skirts 28 depend from opposite edges of ramp 14, as best viewed in FIG. 2. Each lateral skirt 28 extends to the bottom wall, which with a side wall 18 and a portion of the front wall 22 forms a trough 16. The troughs 16 generally extend the length of the ramp adjacent the sides thereof and are in fluid communication with a well 30 which is formed by portions of the bottom wall 24 and the side walls 18, the rear wall 20 and the skirt 26. The well 30 is best viewed in FIG. 13.

The well 30 and troughs 16 allow for even distribution of paint on the bottom surface area of the paint tray 10. The added volume of the troughs provides stability to the paint tray and promotes spill-free use. With the weight of the paint more evenly distributed, the user will find that the paint tray when loaded is easier to move from one location to the other than are conventional trays since awkward shifts in weight due to agitation of the paint are less likely to occur. Thus, paint is less likely to spill onto the floor or onto surfaces which have already been finished. Additionally, in prior art paint trays manufactured from lightweight plastic or the like, concentration of paint weight in the well caused the tray to twist or sag when lifted and carried. The troughs 16 prevent such sagging or twisting because the weight of the paint is no longer concentrated at one end of the tray. The present paint tray 10 provides these advantages while maintaining the useful features of the cylindrical applicator 12 and the ramp 14. In conventional paint trays, the ramp causes paint to concentrate in the well and the addition of an applicator in the well aggravates weight distribution problems.

The preferred embodiment of the tray may be held and carried with one hand. The user simply grips the underside of one of the troughs 16 with the fingers underneath the tray near the bottom of ramp 14. The butt of the hand and the thumb extend along the outside of the corresponding side wall 18. The added stability provided by the troughs 16 allows the user to hold the tray with one hand and load a painting tool via applicator 12 with the other hand. This may all be accomplished directly at the paint detailing site so that repeated trips up and down a ladder and frequent repositioning of the paint tray are eliminated.

Figure 4:
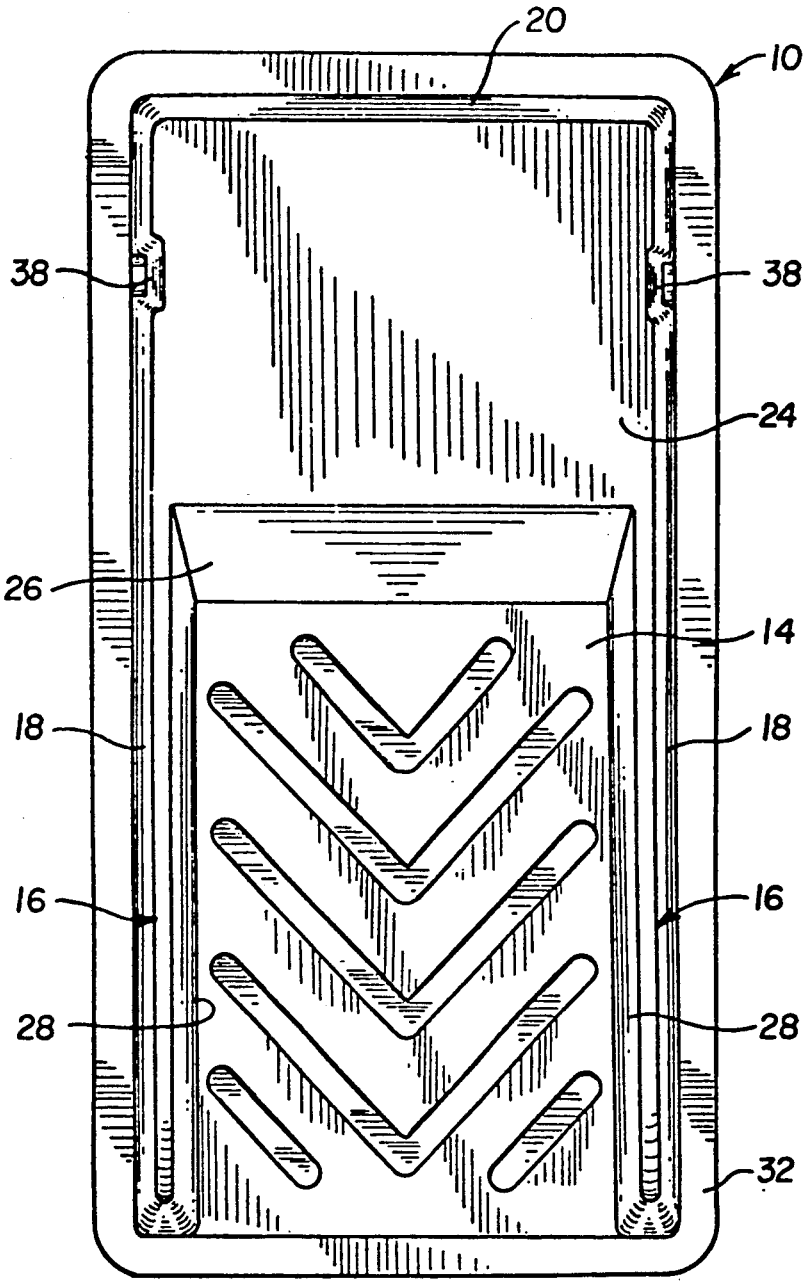
FIG. 4 is a bottom plan view thereof.
Figure 5:
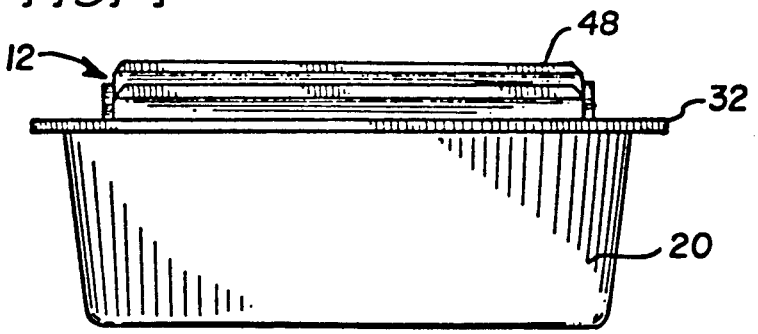
FIG. 5 is a rear elevational view thereof.

The troughs 16 also provide a means of stabilizing the tray when the user rests the tray on a level surface. Conventional trays are prone to rocking when a paint roller is contacted with the ramp for transfer of paint. With the present tray 10, the lower portions of the troughs 16, shown in FIG. 4, provide a bearing which prevents the tray from rocking when pressure is applied on the upper surface of the ramp 14. The bottom wall portion of the troughs 16 and the bottom wall portion of the well 30 provide a greater degree of friction when the tray is bumped or shifted on a level surface, thus minimizing dislocation of the tray and consequent spillage when the tray is struck with horizontally directed forces. Finally, the troughs 16 provide a relatively small volume for storage of paint which is significantly advantageous in loading paint onto smaller tools used in fine detailing. Due to their confined volume, the troughs 16 allow for minimal loading of paint onto smaller tools, which tend to become overloaded if dipped into larger volumes of paint thus increasing the risk of blotching.

The tray 10 also includes a flanged rim 32 which extends from the top edges of side walls 18 and rear and front walls 20, 22 and surrounds the perimeter of the tray to provide an area for stripping of excess paint from smaller paint tools. For stripping excess paint from larger tools, a plurality of corrugated ribs 34 are located on the ramp 14 as shown in FIGS. 1, 8, 10 and 12. The corrugated ribs 34 are integrally molded in the ramp 14. Those of ordinary skill in the art will appreciate that there exist various other ways of providing the ramp 14 with such ribs, including individual attachment of such ribs onto the surface of the ramp 14 after the ramp has been molded.

Figure 17:
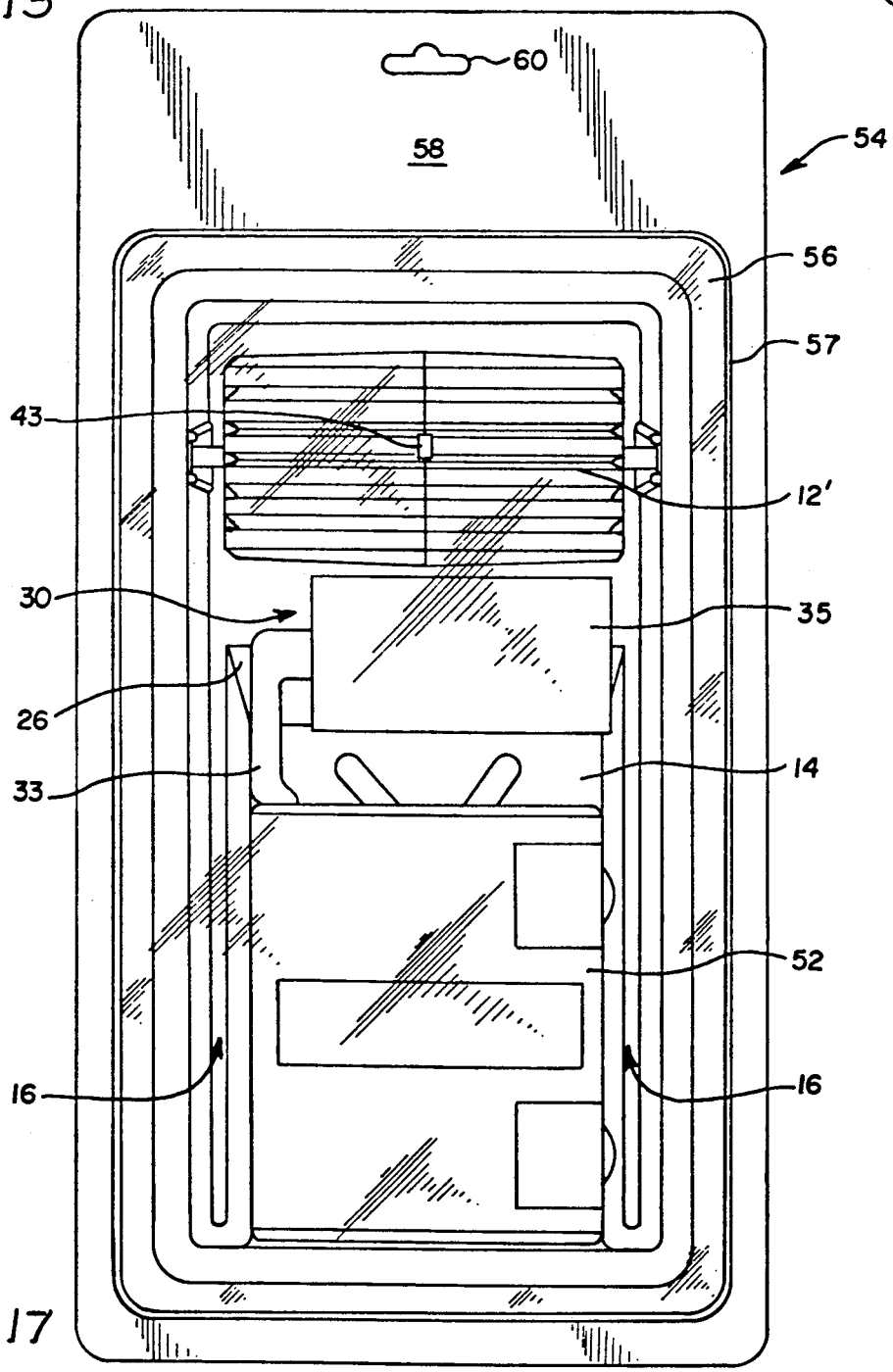
FIG. 17 is a top plan view of a trim tray kit.

The corrugated ribs 34 provide a further advantage both when the ribs are used for stripping excess paint and when the ramp 14 is used to apply paint to various tools, such as a paint roller 35 in FIG. 17. As the tool is drawn up the ramp 14, the corrugated ribs 34 act to strip excess paint and channel it towards the lateral edges of the ramp 14, thereby maintaining an even distribution of paint in both the troughs 16 and in the well 30. More particularly, when the ramp 14 is being used to apply paint to a paint roller, the corrugated ribs 34 temporarily retain excess paint on the ramp so that subsequent passes up and down the ramp with the paint roller will facilitate paint loading without the need for dipping the paint roller back into the well 30.

Figure 6:
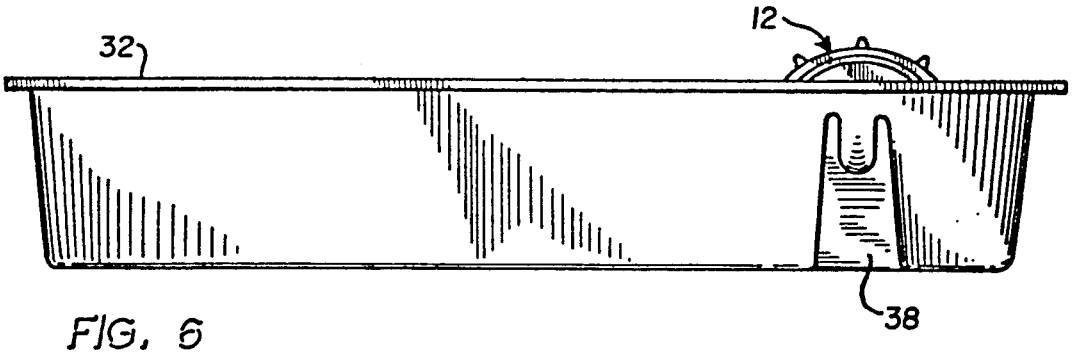
FIG. 6 is a side elevational view thereof.
Figure 7:
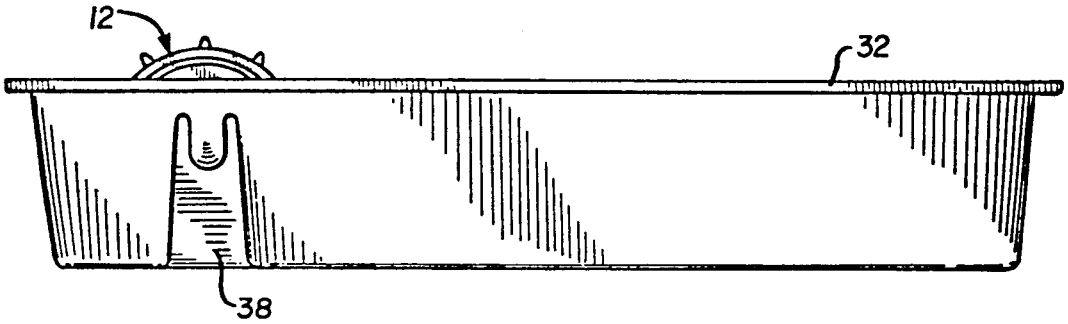
FIG. 7 is an elevational view of the opposite side thereof.
Figure 8:
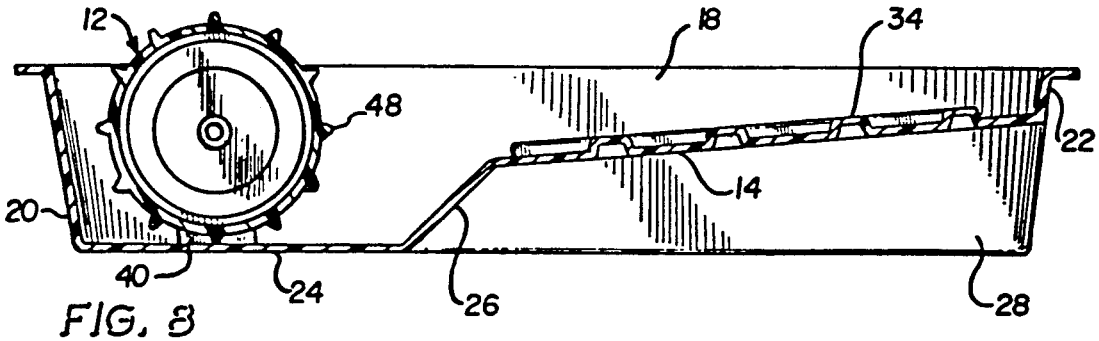
FIG. 8 is a sectional view taken along lines VIII—VIII of FIG. 2.
Figure 14:
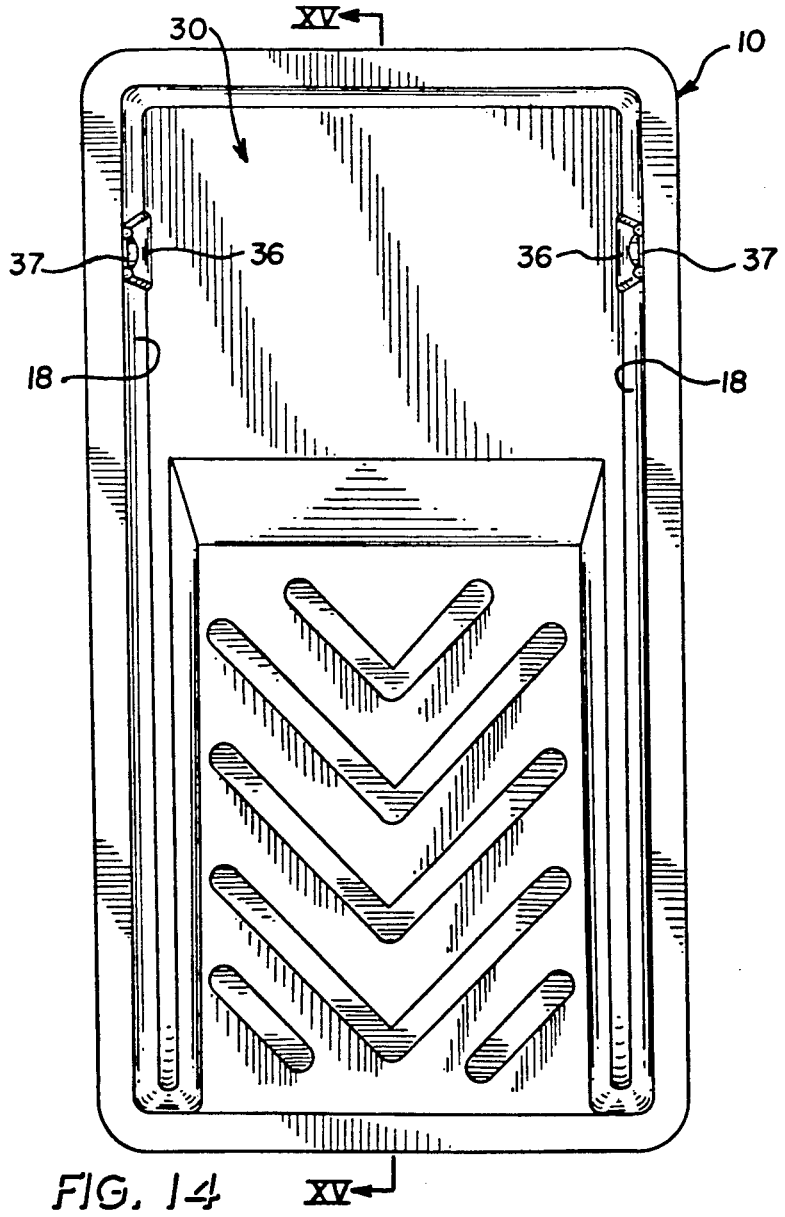
FIG. 14 is a top plan view thereof.
Figure 15:
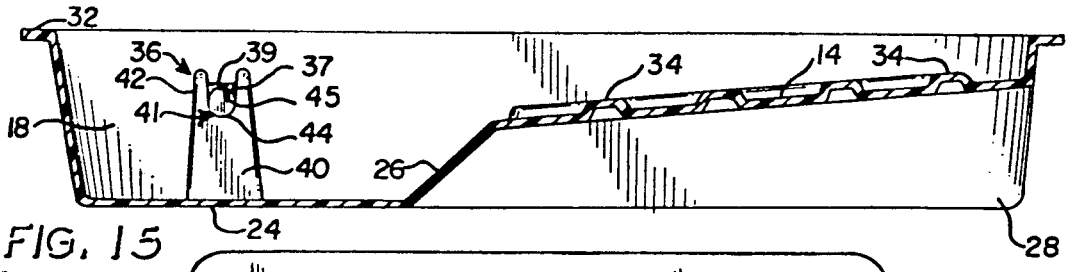
FIG. 15 is a sectional view taken along lines XV—XV of FIG. 14.

Referring to FIG. 14, a boss 36 is located on either side wall 18 adjacent to the well 30. The boss 36 provides support for cylindrical applicator 12. Each boss 36 has a corresponding indentation 38 in the outer surface of the side walls 18. These are best shown in FIGS. 6 and 7. FIG. 15 displays a boss 36 in elevation, and it will be appreciated that the boss 36 includes a lower base portion 40 which cooperates with two upwardly directed fingers 42 to form a U-shaped bearing 44.

Figure 9:
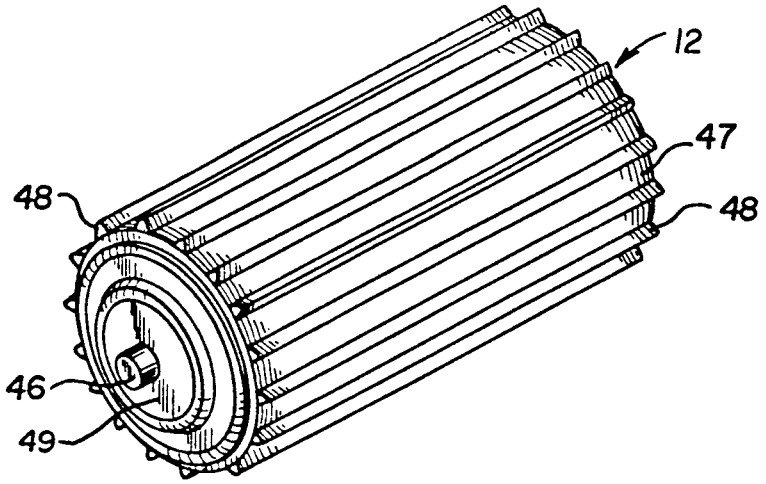
FIG. 9 is a perspective view of a cylindrical applicator.
Figure 10:
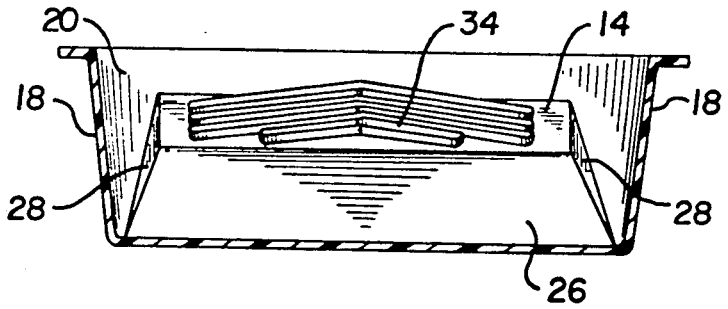
FIG. 10 is a sectional view taken along lines X—X of FIG. 2.
Figure 11:
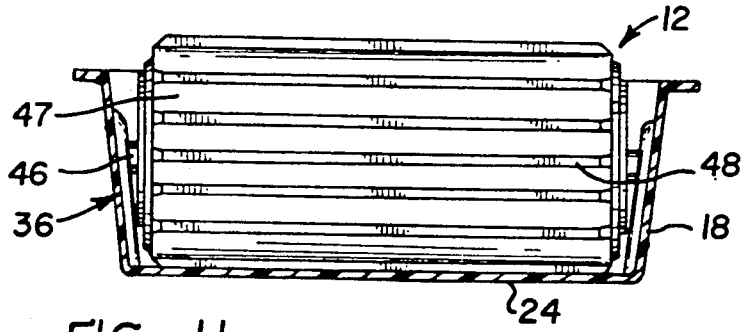
FIG. 11 is a sectional view taken along lines XI—XI of FIG. 2.
Figure 12:
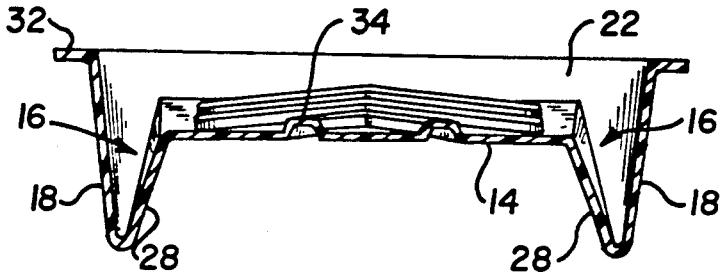
FIG. 12 is a sectional view taken along lines XII—XII of FIG. 2.

The cylindrical applicator 12 is shown in perspective in FIG. 9. The applicator has a body 47 with two end faces 49. A protruding axle stub 46 extends axially from each end face 49 of the applicator. The axle stubs 46 are journaled in the U-shaped bearings 44 to rotatably suspend the cylindrical applicator 12 above the bottom wall 24. When in place, the applicator extends between the side walls 18 in the area of the well 30.

The body 47 of the cylindrical applicator 12 is elongated and includes a plurality of outwardly projecting ribs 48, spaced at intervals about the circumference of the applicator 12 and extending longitudinally from one end of the applicator to the other. The cylindrical applicator 12 may be hollow and it may be formed from blow-molded plastic. The ribs 48 generally aid in pickup and transfer of paint from the well 30 onto various painting tools. The radial extent of the applicator is sufficient to cause the ribs 48 to collect paint from the well 30 when the cylindrical applicator 12 is rotated in the U-shaped bearings 44 via the protruding axle stubs 46.

Figure 16:
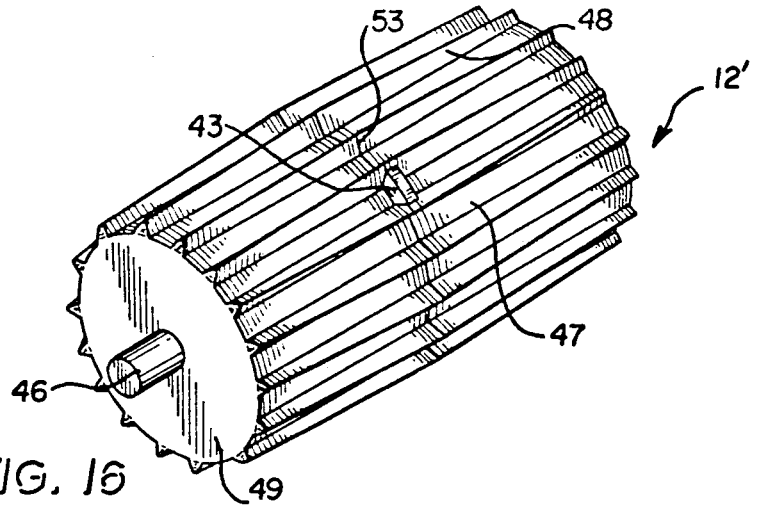
FIG. 16 is a perspective view of a beveled applicator.

The cylindrical applicator 12 may be used to apply paint to padded painting tools, such as an edger 52 shown in FIG. 16. The user draws the pad of the tool tangentially across the upper portion of the applicator 12 causing the applicator to rotate. Partially immersed in paint, the ribs 48 draw paint out of the well 30 and transfer it to the padded tool. The ribs 48 also provide the friction necessary to initiate rotation of the cylindrical applicator 12 with the padded tool.

A second embodiment 12' of the applicator is shown in FIG. 16. The applicator 12' is beveled, i.e., it has a larger diameter in the center of body 47 and is tapered toward each outer end to promote the flow of excess paint from the applicator back into the well 30. This embodiment of the applicator consists of two independently molded sections which snap together via a tab 43. The sections may be pulled apart along a break line 53 on applicator 12' for ease of cleaning.

Figure 13:
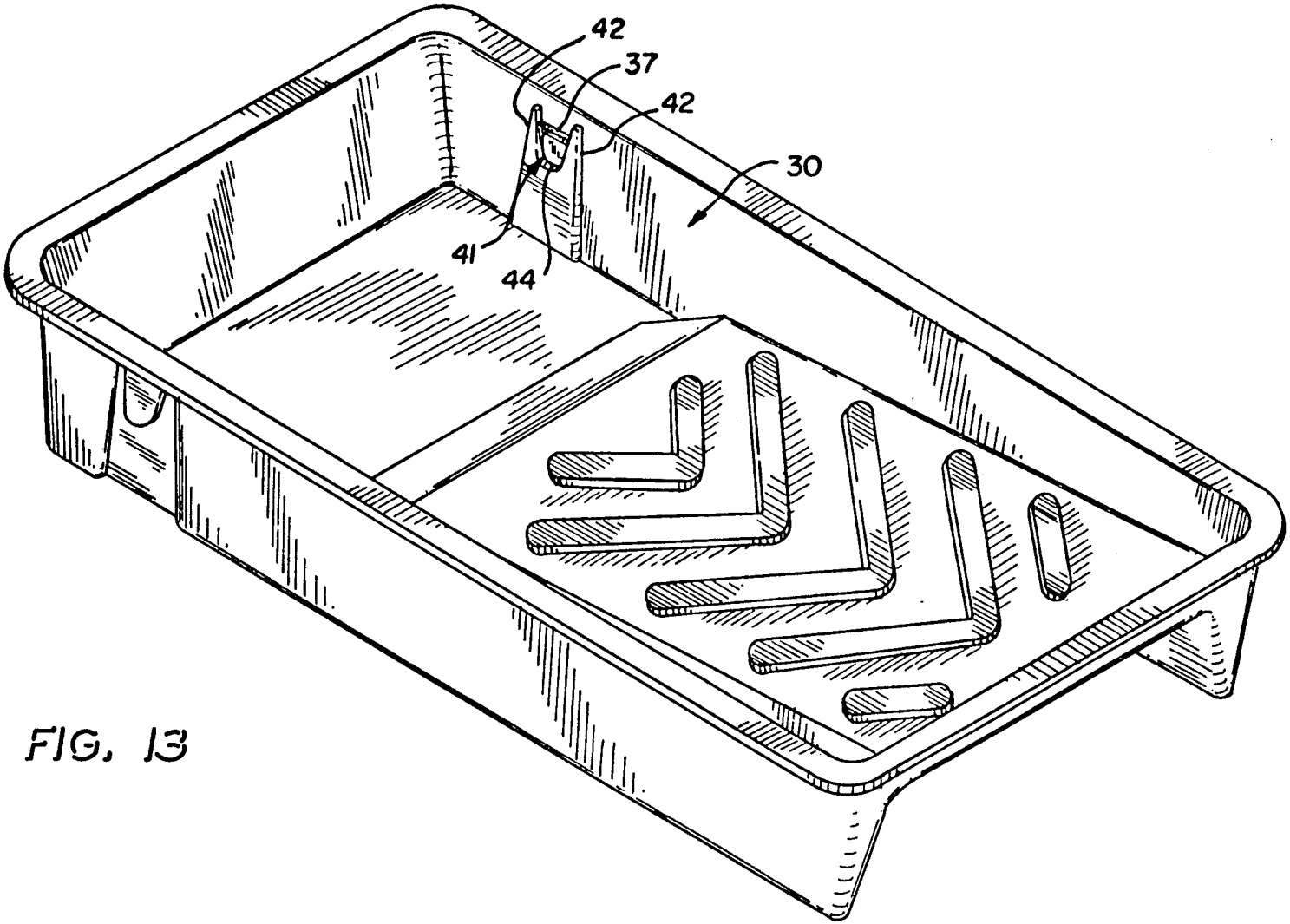
FIG. 13 is a perspective view of a paint tray excluding the cylindrical applicator.

FIGS. 13–15 show the paint tray 10 with an embossed bridge 37 extending between upwardly directed fingers 42. The bridge 37 has a flat upper portion 39 and a tapered lower portion 45 which along with the U-shaped bearing 44 defines a recess 41. Each axle stub 46 snaps into engagement with one of the recesses 41 to secure the cylindrical applicator 12 within the well 30. Particularly, a first stub 46 is inserted directly into a recess 41 and the other stub is brought into engagement with the upper portion 39 of the corresponding bridge 37. The body 47 of the applicator is then pressed downward, forcing side wall 18 slightly outward until stub 46 clears the lower portion 45 and engages recess 41. Side wall 18 then snaps back into place and bridge 37 retains the stub 46. The bridge 37 prevents upward movement of the axle stub 46 out of the boss 36, and the cylindrical applicator will not fall out of the bearings, even when the tray is turned upside down.

The tapered lower portion 45 allows for smooth, splatter-free withdrawal of the applicator 12 when desired. The applicator may be gripped with the thumb and forefinger on each end face 49, respectively, one of the stubs 46 is drawn upward to engage lower portion 45 on bridge 37. The tapered lower portion 45 allows for gradual expansion of side wall 18 as the stub is lifted upward. The stub is lifted clear of bridge 37, and the other stub is pulled directly from its recess 41.

Referring to FIG. 17, the tray 10 may be incorporated with various painting tools, such as edger 52 and roller 35 to form a trim tray kit 54 for use in fine detail painting applications. Specifically, the roller 35 may be positioned in the well 30 between the applicator 12' and the front skirt 26 of ramp 14. A handle 33 of roller 35 thus extends upward along ramp 14. Edger 52 is then stacked on top of handle 33 and it too extends longitudinally along ramp 14. Ample space remains for placement of further tools within troughs 16, even in the compact, preferred commercial embodiment of the tray. Additionally, the applicator 12' may be broken into two sections, and the sections may be designed to nest within one another to provide still further space in well 30 for incorporation of tools. The user simply assembles applicator 12' and inserts stub shafts 46 into recesses 41 and the tray is ready for use.

The preferred embodiment of the trim tray kit 54 is relatively compact when compared to conventional trays. The compact size is more suitable for use of the tray in paint detailing as discussed above. For example, the preferred tray 10 is only 9½ inches in length and 5 inches wide, with a depth in the well 30 and troughs 16 of 1¾ inches. The ramp 14 is 5¼ inches long and 3⅝ inches wide, and the cylindrical applicator 12 has a diameter of 2⅛ inches. Roller 35 is 3 inches wide with a 1½ inch diameter and edger 52 is 3½×4⅜ inches.

The components of the trim tray kit 54 may be shrink-wrapped for ease of handling and storage or they may be contained within a pre-molded plastic cover 56 having a flange 57 which is in turn glued to a cardboard backing 58 which serves as a point-of-purchase display. The cardboard backing has a perforated slot 60 for ease of display. The roller 35 and the edger 52 may be disposed in well 30 and on ramp 14 of the tray as previously described so that no tool extends above the height of cylindrical applicator 12. This enhances the compactness of kit 54. Alternatively, plastic cover 56 may be contoured to conform to the cylindrical applicator 12 and edger 52 to limit shifting of the components during handling and storage.

From the foregoing, it will be appreciated that the paint tray of the present invention provides for efficient application of paint to various painting tools, particularly those used in fine detail painting. The troughs 16 provide for even distribution of paint when loaded into the tray and, thus, stability of the tray is enhanced over the prior art. The preferred embodiment of the kit is stable, may be held with one hand and includes a beveled applicator and tools for paint detailing, all packaged within the tray to form a single unit. The compact paint tray and its components may be cleaned after use, or all may be conveniently disposed of with the tools placed back into the tray.

While particular forms of the invention have been illustrated and described, it will be apparent that various modifications can be made without departing from the spirit and scope of the invention. Accordingly, it is not intended that the invention be limited, except as by the appended claims.

I claim:

1. A paint tray comprising:

two side walls, a rear wall, a front wall and a bottom wall wherein portions of said side walls, rear wall and bottom wall define a well;

a ramp having a front edge and two opposite edges extending downwardly from said front wall in the direction of said well intermediate said side walls;

a skirt depending from each opposite edge of said ramp, said skirt and portions of said side walls, front wall and bottom wall forming at least two troughs;

a front skirt extending downwardly from the front edge of said ramp at a steeper gradient relative to the ramp, said front skirt intersecting with said bottom wall in the area of said well;

bearing means comprising a boss having two upwardly directed fingers, said bearing means integral with said side walls adjacent said well, said bearing means further comprising an embossed bridge extending between said upwardly directed fingers, said bridge tapered downward to define a recess between said fingers;

an applicator having a body and two end faces with a plurality of ribs extending longitudinally on said body and an axial stub protruding from each end face, each axial stub snapping into engagement with one of said recesses to journal said applicator in the well above the bottom wall; and said paint tray adapted to receive a plurality of tools disposed within said well and said troughs and upon said ramp.

2. The paint tray according to claim 1 further including a flanged rim extending from a top edge of said front wall, rear wall and side walls around the perimeter of said tray.

3. The paint tray according to claim 1 wherein said ramp includes a plurality of corrugated ribs extending from a central portion of said ramp outward toward each opposite edge of the ramp.

4. The paint tray according to claim 1 wherein the body of said applicator has a greater diameter in its center and tapers to a smaller diameter at each end face 5. The paint tray according to claim 4 wherein said applicator comprises two separable, independently molded sections.

6. The paint tray according to claim 1 wherein said tools include a roller and an edger, said roller positioned in the well of said tray between the applicator and the front skirt with the handle of said roller extending upward along the ramp, the edger being positioned on top of said handle along said ramp.

7. A paint detailing kit comprising:

a paint tray having two side walls, a rear wall, a front wall and a bottom wall wherein portions of said side walls, rear wall and bottom wall define a well;

a ramp having a front edge and two opposite edges extending downwardly from said front wall in the direction of said well intermediate said side walls;

a skirt depending from each opposite edge of said ramp, said skirt and portions of said side walls, front wall and bottom wall forming at least two troughs;

a front skirt extending downwardly from the front edge of said ramp at a steeper gradient relative to the ramp, said front skirt intersecting with said bottom wall in the area of said well;

bearing means comprising a boss having two upwardly directed fingers, said bearing means integral with said side walls adjacent said well, said bearing means further comprising an embossed bridge extending between said upwardly directed fingers, said bridge tapered downward to define a recess between said fingers;

an applicator having a body with a plurality of longitudinally extending ribs thereon and two end faces with protruding axial stubs, each axial stub snapping into engagement with one of said recesses to journal said applicator above the bottom wall in the well, said body having a greater central diameter and tapering to a smaller diameter at each end face; and a plurality of tools used in detail painting, disposed within said tray in said well and upon said ramp and packaged to form a single unit.

8. The kit according to claim 7 wherein said tools comprise a paint edger and a paint roller.

9. The kit according to claim 8 wherein said roller is positioned in the well of said tray between the applicator and the front skirt with the handle of said roller extending upward along the ramp, the edger being positioned on top of said handle along said ramp.

10. The kit according to claim 7 wherein said applicator comprises two separable, independently molded sections.

11. The kit according to claim 7 further including a flanged rim extending from a top edge of the front wall, rear wall and side walls around the perimeter of said tray.

12. The kit according to claim 7 wherein said ramp includes a plurality of corrugated ribs extending from a central portion of said ramp outward toward each opposite edge of the ramp.

13. The kit according to claim 7 including a backing having a perforated slot and a cover which secures said paint tray to the backing.

14. The kit according to claim 13 wherein said cover comprises a pre-molded plastic cover having a flange which extends from its lower edges and which is glued to said backing.

15. A paint detailing kit comprising:

a paint tray having two side walls, a rear wall, a front wall and a bottom wall wherein portions of said side walls, rear wall and bottom wall define a well;

a ramp having a front edge and two opposite edges extending downwardly from said front wall in the direction of said well intermediate said side walls, said ramp having a plurality of angular corrugated ribs extending from a central portion of said ramp outward toward each opposite edge;

a skirt depending from each opposite edge of said ramp, said skirt and portions of said side walls, front wall and bottom wall forming at least two troughs;

a front skirt extending downwardly from the front edge of said ramp at a steeper gradient relative to the ramp, said front skirt intersecting with said bottom wall in the area of said well;

a flanged rim extending from a top edge of said front wall, rear wall and side walls around the perimeter of said tray;

bearing means comprising a boss having two upwardly directed fingers, said bearing means integral with said side walls adjacent said well, said bearing means further comprising an embossed bridge having a flat upper portion and a tapered lower portion extending between said upwardly directed fingers, said bridge defining a recess between said fingers;

an applicator having a body with a plurality of longitudinally extending ribs thereon and two end faces with protruding axial stubs, each axial stub snapping into engagement with one of said recesses to journal said applicator above the bottom wall in the well, said applicator including two separable sections with said body having a greater central diameter and tapering to a smaller diameter at each end face;

a plurality of tools used in detail painting, disposed within said tray, said tools including a paint roller and an edger, said paint roller positioned in the well of said tray between said applicator and said front skirt with the handle of said roller extending upwardly along said ramp, said edger positioned on top of said handle along said ramp;

a backing having a perforated slot; and a pre-molded plastic cover having a flange which extends from its lower edges and which is fixed to said backing to secure said tray and said tools thereto, said plastic cover contoured to conform to said applicator and said edger.

* * * * *